US010170852B2

(12) United States Patent
Betz

(10) Patent No.: US 10,170,852 B2
(45) Date of Patent: Jan. 1, 2019

(54) METHOD FOR MANUFACTURING PLUG-TYPE CONTACTS, PLUG-TYPE CONTACT AND COMPONENT ASSEMBLY COMPRISING AT LEAST ONE PLUG-TYPE CONTACT

(71) Applicant: Walter Söhner GmbH & Co. KG, Schwaigern (DE)

(72) Inventor: Thomas Betz, Leingarten (DE)

(73) Assignee: Walter Söhner GmbH & Co. KG, Schwaigern (DE)

( * ) Notice: Subject to any disclaimer, the term of this patent is extended or adjusted under 35 U.S.C. 154(b) by 0 days.

(21) Appl. No.: 14/883,794

(22) Filed: Oct. 15, 2015

(65) Prior Publication Data

US 2016/0049743 A1 Feb. 18, 2016

Related U.S. Application Data

(63) Continuation of application No. PCT/EP2014/050749, filed on Jan. 16, 2014.

(30) Foreign Application Priority Data

Apr. 16, 2013 (DE) ..... 10 2013 103 818

(51) Int. Cl.
*H01R 13/42* (2006.01)
*H01R 13/415* (2006.01)
(Continued)

(52) U.S. Cl.
CPC ..... *H01R 13/415* (2013.01); *H01R 12/585* (2013.01); *H01R 43/16* (2013.01)

(58) Field of Classification Search
CPC ..... H01R 9/091; H01R 12/585; H01R 12/58; H05K 3/308
(Continued)

(56) References Cited

U.S. PATENT DOCUMENTS 3,391,567 A 7/1968 Gregory
4,217,024 A * 8/1980 Aldridge ..... H01R 4/028 439/381
(Continued)

FOREIGN PATENT DOCUMENTS

DE 44 22 876 A1 1/1995
DE 202 18 295 U1 5/2003
(Continued)

*Primary Examiner* — Hien Vu
(74) *Attorney, Agent, or Firm* — Arent Fox LLP

(57) ABSTRACT

The invention relates to a press-in contact, a component assembly comprising at least one contact receptacle and a press-in contact, and a method for manufacturing a press-in contact, The method comprising producing a rough contour, in particular a punched contour, of a press-in contact, with a connecting body and two limbs which adjoin the latter and are arranged opposite each other, wherein the limbs have press-in regions and end regions which face away from the connecting body and have contact portions which face each other and are spaced apart from each other in a defined manner, and reshaping the limbs, comprising moving the end regions of the limbs toward each other by at least partial plastic deformation of at least one of the limbs, wherein the contact portions of the limbs touch in a defined manner at least in sections after being relieved of load.

4 Claims, 6 Drawing Sheets

(51) Int. Cl.
*H01R 12/58* (2011.01)
*H01R 43/16* (2006.01)

(58) Field of Classification Search
USPC ..... 439/82, 751
See application file for complete search history.

(56) References Cited

U.S. PATENT DOCUMENTS

| | | | | |
|---|---|---|---|---|
| 4,797,113 | A * | 1/1989 | Lambert | H01R 12/52 439/295 |
| 5,115,375 | A * | 5/1992 | Garay | H05K 7/142 361/760 |
| 6,309,259 | B1 * | 10/2001 | Yamashita | H01R 12/585 439/439 |
| 8,092,262 | B1 | 1/2012 | Frederick et al. | |
| 8,313,344 | B2 * | 11/2012 | Johnescu | H01R 12/585 439/571 |
| 8,419,484 | B2 * | 4/2013 | Kawai | H01R 12/585 439/733.1 |
| 2007/0072495 | A1 | 3/2007 | Nakamura et al. | |
| 2007/0212907 | A1 | 9/2007 | Kramski | |
| 2011/0159743 | A1 | 6/2011 | Johnescu et al. | |

FOREIGN PATENT DOCUMENTS

| | | | |
|---|---|---|---|
| GB | 2 121 620 | A | 12/1983 |
| WO | 93/15532 | A1 | 8/1993 |

* cited by examiner 100a
10
b
22
7
1
21
6

21
1
22
d

100a'
10
22
7
1
21
6

21
1
22

100a"
42
44
10
22'
7
1
21'
6

21'
42
1
22'
44
50
52

100a'''
4
5
9
22"
7
1
21"
6

46
21"
42
1
22"
44
48

100a''''
3
4
5
9
22'''
7
1
21'''
6

F
21'''
1
22'''
B

METHOD FOR MANUFACTURING PLUG-TYPE CONTACTS, PLUG-TYPE CONTACT AND COMPONENT ASSEMBLY COMPRISING AT LEAST ONE PLUG-TYPE CONTACT

CROSS REFERENCES TO RELATED APPLICATIONS

This application is a continuation of copending international application PCT/EP2014/050749 filed on Jan. 16, 2014 designating the U.S. and published in German language on Oct. 23, 2014. The international application claims priority of German patent application DE 10 2013103818.2, filed on Apr. 16, 2013.

BACKGROUND

The present invention relates to a method for manufacturing plug-type contacts, in particular press-in contacts, which have a connecting body and two limbs which adjoin the latter and define a press-in region for reception in a contact receptacle. The invention furthermore relates to a corresponding plug-type contact, in particular a press-in contact, and to a component assembly comprising at least one such plug-type contact, in particular a press-in contact.

A press-in contact and a method for manufacturing a press-in contact are known from WO 2005 122 337 A1. The known press-in contact comprises a contact body and two limbs which are formed as a single piece therewith and are formed by means of non-cutting machining, wherein a separating operation and an expansion are provided in order to form a press-in region. The two limbs form a point at which a separating gap is provided.

In a similar manner, DE 202 18 295 U1 discloses a contact element for printed circuit boards, having a pin part which is intended for pressing into a bore in the printed circuit board and has two approximately parallel arms which are formed in pairs so as to be movable toward each other counter to a resetting force.

Press-in connections, in particular press-in contacts, of a general type are adequately known in the prior art and are suitable in particular for producing electric contacts having small transition resistances. The connections can be manufactured rapidly and cost-effectively and, given correct configuration, production and installation, can ensure a high degree of reliability and a long service life. It is known to provide press-in contacts with deformable shape elements which are intended to be deformed as far as possible in a defined manner during the installation of the contact and are intended to provide a certain contact force or retaining force.

Press-in connections make it possible to at least partially substitute, for example, integral bonding methods, for example soldered joints. Press-in connections can be customarily produced by forming both a non-positive component and a positive component. In the case of the press-in contact and/or the associated contact receptacle, it is possible to produce at least minimal deformations which can contribute to increasing the retaining force and to an enlargement of the contact surface.

However, it has been shown that known press-in contacts can have tolerance fluctuations caused by the production which, in turn, can be reflected in the large degree of dispersion in installation forces and/or contact forces of the joined connections. This may firstly lead to an insufficiently large contact force being producible, and therefore the desired reliability of the connection is not provided. Furthermore, in this arrangement, an increased transition resistance and/or a reduced contact surface between the press-in contact and a contact receptacle may be produced.

Conversely, i.e., for example, if an impermissibly high joining force is required for the installation of the press-in contact, which may also lead to an increased contact force, components may be damaged during the installation of the press-in connections. This may also reduce the reliability and service life of the connection. The above-described disadvantages are more apparent the higher the tolerance requirements imposed on the press-in connections are. However, increased tolerances may be required in order, for example, to be able to obtain a miniaturization and/or an increase of the packing density, i.e., for example, of the number of connections per unit area. Requirements of this type may arise, for example, in the field of vehicle engineering, in particular electric mobility, in which frequently high currents flow in order to transmit high powers at comparatively low voltages.

SUMMARY

Against this background, the invention is based on the object of specifying as economical as possible a method for manufacturing plug-type contacts, which method can ensure a high degree of reproducibility and faithfulness to tolerances and can simplify the installation of the plug-type contacts as far as possible. Furthermore, the intention is to provide a plug-type contact which can be manufactured as economically as possible with high tolerance quality and with which press-in connections which can be reproduced as precisely as possible can be produced in a simple manner.

This object is achieved according to the invention by a method for manufacturing plug-type contacts, comprising the following steps:

Producing a rough contour, in particular a punched contour, of a plug-type contact, with a connecting body and two limbs which adjoin the latter and are arranged opposite each other, wherein the limbs have press-in regions and end regions which face away from the connecting body and have contact portions which face each other and are spaced apart from each other in a defined manner; and Reshaping the limbs, comprising moving the end regions of the limbs toward each other by at least partial plastic deformation of at least one of the limbs, wherein the contact portions of the limbs touch in a defined manner at least in sections after being relieved of load.

The object addressed by the invention is thereby completely achieved.

This is because, according to the invention, firstly the rough contour can be produced particularly simply since the contact portions of the two limbs can be sufficiently spaced apart from each other. This permits, for example, the use of relatively simply designed, robust separating tools or punching tools. The additional reshaping operation which takes place before installation of the plug-type contact makes it possible in a simple manner to be able to manufacture the plug-type contacts in a highly precise way with exacting tolerances. By the reshaping operation namely being configured in such a manner that the contact portions of the limbs touch after the reshaping, large tolerance fluctuations which are customarily associated with "free" reshaping operations can be avoided. A "free" reshaping operation is intended to be understood here as meaning, for example, a production step in which the limbs are deformed in such a manner that a geometrically definable gap, i.e. a defined spacing, is then produced between the contact portions thereof.

Of course, it would be significantly more complex to produce a defined gap between the two limbs than to bring said limbs into contact with each other in a defined manner. The final shape of the plug-type contact can be reproduced in a highly precise way in this manner. Accordingly, significantly reduced fluctuations in the installation force or the press-in force and in the contact force of the joined press-in connection can arise. The reliability of producing corresponding press-in connections can be significantly increased. Transition resistances arising in the press-in connection are subject to smaller fluctuations.

In comparison to press-in connections, in which the end regions of the limbs are formed continuously, i.e. are connected in one piece or in an integrally bonded manner to each other, in the case of a plug-type contact which is provided with limbs which have separate contact portions, but which touch in a defined manner in sections, further advantages are afforded during the installation. During the joining, i.e. during the production of the press-in connection, the contact portions of the limbs can namely roll on each other in a defined manner as a result of the deformation of the limbs. In other words, during the joining operation, a touching surface between the contact portions can change, in particular can be enlarged. This makes it possible to increase the elasticity or flexibility of the plug-type contact during the pressing-in operation such that the manufacturing of the press-in connection can proceed more simply and with greater accuracy. This is true in particular in comparison to press-in contacts, in which the end regions of the limbs are connected rigidly and fixedly to each other.

In other words, a plug-type contact which is produced in accordance with the abovementioned method can combine the advantages of press-in contacts with limbs which have contact portions spaced apart from each other (high elasticity) and the advantages of press-in contacts which have limbs, the end regions of which are rigidly connected to each other (high degree of accuracy, small shape deviations), without having to accept the respective specific disadvantages.

The limbs can be reshaped, for example, in such a manner that the two limbs are moved toward each other simultaneously or offset laterally in order for the contact portions to make contact with each other. In principle, however, it would also be conceivable only to reshape one of the two limbs in order to produce the contact between the limbs. Accordingly, the term "move toward each other" is intended in general to be understood as meaning a relative movement, which is directed toward each other, between the end regions of the limbs.

The contact portions can be designed in particular as mutually facing contact surfaces on the limbs. After the reshaping of the limbs, a continuous point can be produced in the plug-type contact, said point being formed by the end regions of the two limbs and in particular not having any gap or any spacing.

The rough contour can be in particular a semi-finished product consisting of a flat material or strip material with a substantially planar extent. In principle, conductive materials, in particular metals, are suitable. The rough contour can be produced by way of example by means of a cutting operation. In this connection, for example, punching operations and/or precise cutting operations can be used. In general, non-cutting separating methods are suitable for producing the rough contour.

The plug-type contact can in principle be assigned to a further component, i.e., for example, can be connected as a single piece therewith. This may involve a current terminal, for example a busbar. In particular, a plurality of plug-type contacts can be simultaneously formed on one component. By way of example, said plug-type contacts can be manufactured simultaneously with a multiple mold. However, it would also be conceivable to manufacture a plurality of plug-type contacts one after another on a component.

The plug-type contact is preferably designed as a press-in contact.

In an advantageous development of the method, the plastic deformation during the reshaping is introduced in such a manner that, after the reshaping, the contact portions of the limbs are prestressed against each other with a contact force.

The effect which can be achieved by this measure is that the contact portions of the limbs not only at least partially touch, but even act on each other with a force. In this manner, the manufacturing of the press-in contacts can take place particularly reliably since contact between the contact portions is always ensured even in the event of possible fluctuations of the contact force. In other words, a geometrical requirement (the contact connection) can be replaced by a requirement of a certain force (the contact force), wherein sufficiently large tolerances with respect to the contact force are permitted. However, even in the case of large tolerance fluctuations, the geometrical requirement is always can be met.

According to a further embodiment, the limbs are reshaped with an inner contour being formed, which inner contour permits flexibility of the limbs during the installation of the press-in contact.

Even if the limbs are rigidly connected to each other at the end thereof facing the connecting body and, in the end regions thereof facing away from the connecting body, have contact portions which touch each other, a deformable flexible region can be produced between the ends. The inner contour can be in particular an inner recess which is bounded by inner sides of the two limbs. This configuration also contributes to increasing the elasticity of the press-in contact.

In a preferred development of the method, the reshaping of the limbs furthermore comprises a lateral deflection of at least one of the limbs, wherein at least the contact portions of the limbs are offset laterally with respect to each other in a deflected position.

Within the context of this application, the "lateral deflection" should be understood as meaning an at least partial shifting of the at least one limb, the shifting having at least one movement component which is directed perpendicularly to a planar extent of the press-in contact. The planar extent of the press-in contact can customarily coincide with the planar extent of the flat material from which the press-in contacts are manufactured.

In other words, the limbs can be arranged, for example, in such a manner that inner sides of the limbs face each other while outer sides of the limbs face away from each other. In addition to the inner sides and the outer sides of the limbs, lateral sides can furthermore be provided, wherein, at least in the undeflected state, the lateral sides of the two limbs are arranged in a plane which is defined by a flat side of the semi-finished product.

It has been shown that, by means of the lateral deflection of the at least one limb during the reshaping, clearances and movement possibilities can be produced that are not provided at any rate if the two limbs remain arranged in the starting position thereof or in the starting plane thereof.

In an advantageous development of this embodiment, the two limbs are deflected laterally in opposite directions. The two limbs, in particular the contact portions thereof, can therefore be offset with respect to each other by an extent which is produced by the two lateral movements. For example, starting from an imaginary lateral neutral position, which corresponds, for example, to a center plane through the press-in contact, which central plane coincides with the longitudinal extent of the latter, it is possible to produce a first lateral direction and a second lateral direction which is opposed to the first lateral direction. It is preferred if the two limbs are deflected laterally in such a manner that the contact portions thereof are offset with respect to each other in the direction of the longitudinal extent of the press-in contact in such a manner that there is no longer any overlap therebetween.

It is furthermore particularly preferred if, during the reshaping, the contact portions of the limbs are moved toward each other and past each other at least in sections. In other words, the laterally deflected or disengaged limbs can first of all be moved toward each other, but, furthermore, because of the offset, can be moved beyond a position at which touching would take place in the undeflected or non-disengaged state between the contact portions. The contact portions of the limbs can be moved at least partially past each other laterally.

The lateral disengagement of the limbs and the moving of the limbs past each other at least in sections can be components of a combined movement, i.e. can proceed at least partially parallel (in time). However, it is also conceivable for the movements mentioned to be able to proceed successively in time. The moving of the limbs toward each other and past each other at least in sections can take place substantially perpendicularly to the deflecting movement of the limbs. The measure mentioned has the substantial advantage that at least one of the limbs, preferably both limbs, can be deformed plastically in such a manner that, after transfer into the lateral starting position, i.e. the lateral neutral position, the touching between the contact portions can be reliably produced and in particular there can be prestressing between the contact portions. A deformation of this type for producing the force could be produced without the lateral disengagement of the limbs only with an increased outlay since the contact portions of the limbs would more likely touch and consequently would not permit any further input of deformation.

Thus, by means of a defined "overstretching" of the limbs, secure contact or touching between said limbs can be produced in a simple manner without excessive accuracy requirements having to be imposed on the deformation.

According to a further embodiment of the method, the lateral deflection substantially takes place by elastic deformation of the limbs. This measure has the particular advantage that, after the reshaping operation, the limbs to a certain extent push back automatically into the lateral neutral position thereof. It is thus conceivable that plastically deformed limbs which move past each other at least in sections (in the longitudinal direction) or the contact portions thereof are moved back counter to said input of movement until the lateral overlap therebetween is eliminated. The limbs can then "snap" back into the neutral position thereof by themselves.

According to a further aspect, the lateral deflection at least partially takes place by plastic deformation of the limbs, wherein the reshaping furthermore comprises a lateral counter movement of the two limbs, as a result of which the contact portions of the limbs are transferred into a lateral neutral position.

According to this embodiment, the limbs also at least partially undergo plastic deformation in the lateral direction. It is therefore conceivable that the limbs cannot "snap" back into the lateral neutral position by themselves. In this case, a further lateral deflection which is directed counter to the original lateral deflection can take place in order, in turn, to bring about a plastic deformation of the limbs that equalizes the previously produced deformation (laterally). The limbs can also be reliably returned into the lateral neutral position thereof in this way, with the contact portions at least partially touching because of the prestress which is introduced. Overall, it is preferred if the press-in contact maintains the substantially flat basic shape thereof even after the reshaping.

According to a further embodiment, the two limbs are punched and reshaped in such a manner that a substantially almond-shaped configuration of the limbs is produced, wherein the two limbs are configured preferably substantially mirror-symmetrically and in particular have a convexly outwardly projecting portion.

The outwardly projecting portions can act in particular as the press-in regions which, in the joined state of the press-in contact, produce the contact with respect to the contact receptacle. The configuration of the two opposite limbs can in general comprise an oval or elliptical shape. The almond-shaped configuration can be distinguished in particular by a pointed end which is defined by the end regions of the limbs. The end facing away from the pointed end can be defined by a transition between the two limbs and the connecting body and can be rounded. This end can in principle also be configured in a pointed manner. In particular, the inner space produced between the limbs can also be of substantially almond-shaped design and can taper in the region of the contact portions and can be provided with a rounding or chamfer in the region of the connecting body.

In an advantageous development, an inner side transition between the press-in region and the contact portion of the limbs is provided with a rounding. It is appropriate in particular to allow the regions to merge tangentially into each other. There are preferably no angular transitions. By way of example, the press-in region of the limbs can be configured to be substantially concave on the inner side, with a convex transition adjoining the contact portion. In this manner, in particular when joining the press-in contact, optimum deformability of the limbs can be produced. When the two limbs are compressed or pressed together, the contact portions thereof can roll on each other. This makes it possible to avoid unfavorable stress profiles which could possibly lead to damage of the components.

In an advantageous development of this embodiment, the two limbs are provided with press-in regions which have a substantially convex outer contour and a substantially concave inner contour, wherein a substantially almond-shaped inner recess is produced between the opposite limbs.

It is thus preferred, according to a further embodiment, if the limbs are configured to be continuously curved and do not have any rectilinear portions in particular in the longitudinal extent thereof. The advantageous configuration of the limbs can be substantially already brought about by the production of a correspondingly configured rough contour. Alternatively or additionally, curved regions of the limbs can also be produced and/or varied by the reshaping of the limbs.

In an advantageous development, at least the connecting body or the limbs is/are shaped by stamping at least in sections. The stamping can be directed in particular toward smoothing or rounding punched edges, burrs or the like. This can firstly contribute to avoiding stress concentrations which could arise during the reshaping of the limbs.

Furthermore, an enlargement of the potential contact surface with the contact receptacle can be brought about in the joined state.

The stamping or shaping by stamping can be a manufacturing step which, for example, follows a punching operation or cutting operation and precedes the reshaping step. It is also of advantage here if there is a sufficiently large spacing between the contact portions of the limbs. It is basically also conceivable to combine the cutting operation for producing the rough contour and the stamping operation for smoothing or rounding edges with each other.

According to a development of the method, the production of the rough contour furthermore comprises production of a concave constriction at the transition between a press-in region and an attachment region, wherein the concave constriction is formed by curved portions of the limbs. This embodiment can produce favorable force profiles during the reshaping or joining of the press-in contact.

The object of the invention is furthermore achieved by a plug-type contact, in particular a punched plug-type contact for producing an electric connection, with a connecting body and two curved limbs adjoining the latter, wherein the connecting body and the limbs are configured as a single piece, wherein each limb has a press-in region and an end region with a contact portion, wherein the two limbs define a substantially almond-shaped inner contour, and wherein the contact portions of the two limbs face each other and touch in a defined manner at least in sections.

The object of the invention is thereby also completely achieved.

The inner contour can in principle also be configured, for example, in a gusset-shaped manner or as a spherical lune. In particular in the direction of the connecting body, the inner contour between the limbs can have a rounding or chamfer. In general, the inner contour can be egg-shaped, elliptical or oval. The two limbs are preferably configured mirror-symmetrical with respect to each other.

The plug-type contact is preferably designed as a press-in contact, in particular as a punched press-in contact.

Such a press-in contact is suitable in particular for transmitting high currents. The press-in contact can provide a sufficiently low transition resistance. It is particularly preferred if the press-in contact is manufactured according to one of the aspects of the abovementioned method.

In a preferred embodiment of the press-in contact, the contact portions of the two limbs are prestressed against each other with a contact force. It is thereby ensured that there is contact between the contact portions of the limbs. A highly precise configuration with low tolerances can therefore be ensured.

According to a development of the press-in contact, the limbs have an attachment region for attachment to the connecting body, wherein the limbs have a concave constriction at a transition between the press-in region and the attachment region, said constriction being formed by curved portions of the limbs, wherein those ends of the limbs which face the connecting body furthermore have an inner rounding which merges into the inner space, and wherein the concave constriction of the limbs defines a narrow point between the inner space and the rounding. At the narrow point, the limbs can touch in a defined manner during the reshaping or joining of the press-in contact. The attachment region can be relieved of load by the inner rounding.

A press-in contact according to one of the abovementioned aspects is preferably used in a component assembly which furthermore has at least one contact receptacle and at least one such press-in contact, wherein the press-in contact is received in the contact receptacle by being prestressed.

It goes without saying that the features of the invention that are mentioned above and that have yet to be explained below are usable not only in the respectively stated combination, but also in other combinations or by themselves without departing from the scope of the present invention.

BRIEF DESCRIPTION OF THE DRAWINGS

Further features and advantages of the invention emerge from the description below of a plurality of preferred exemplary embodiments with reference to the drawings, in which.

DETAILED DESCRIPTION OF EXEMPLARY EMBODIMENTS

Various states of a press-in contact 100 according to an exemplary embodiment are illustrated during the manufacturing process with reference to FIGS. 1*a* to 3*b*.

Figure 10A:
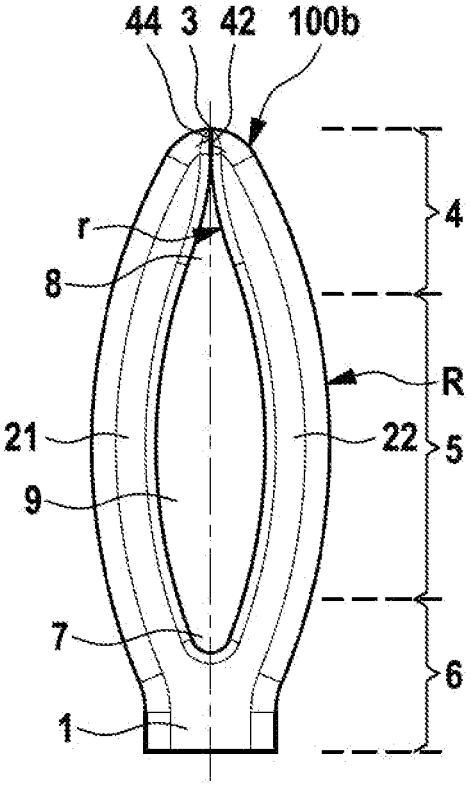
FIG. 10*a* shows a schematically illustrated top view of a further press-in contact with two limbs which touch at least in sections.
Figure 10B:
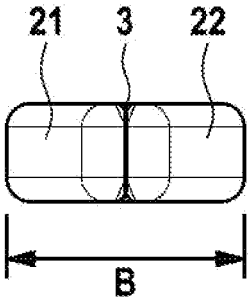
FIG. 10*b* shows a schematically illustrated front view of the press-in contact according to FIG. 10*a;*
Figure 11:
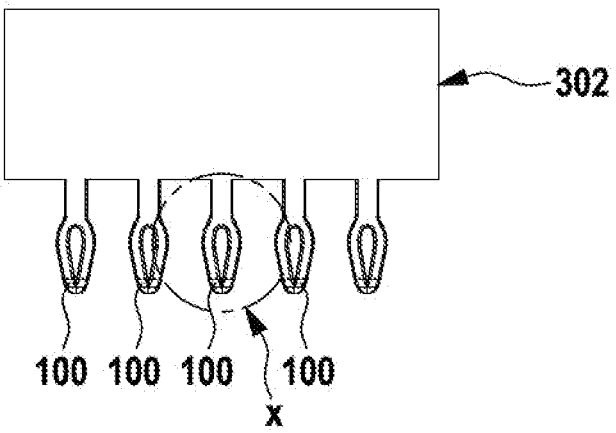
FIG. 11 shows a simplified schematic view of a busbar with a plurality of press-in contacts.

By way of example, the press-in contact 100 can be associated with a contact component, for example a busbar, compare FIG. 11. In particular, a plurality of press-in contacts 100 can be provided on a contact component. It therefore goes without saying that in particular the embodiments illustrated in FIGS. 1*a* to 10*b* can have or contain merely partial illustrations.

Figure 1A:
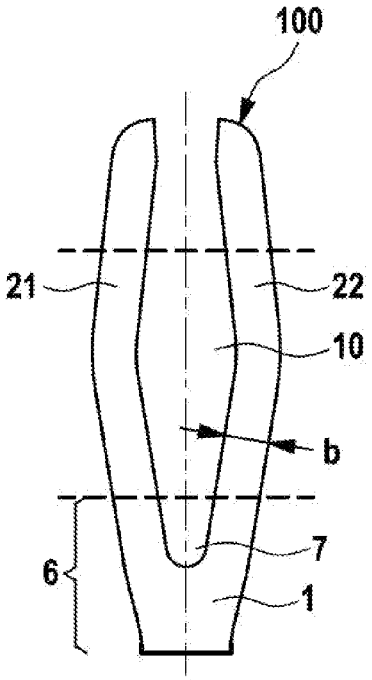
FIG. 1*a* shows a rough contour of a press-in contact with two opposite limbs, in a schematically illustrated top view.

FIGS. 1*a* and 1 *b* illustrate a rough contour of the press-in contact 100. The rough contour can be in particular a punched contour or cut contour which is produced from a substantially flat semi-finished product. The press-in contact 100 has a connecting body 1 from which two limbs or limb elements 21, 22 extend. The connecting body 1 and the limbs 21, 22 are preferably formed as a single piece and in particular are connected integrally to a component. The connecting contour to this component is provided by the connecting body 1. The limbs 21, 22 are configured substantially mirror-symmetrically. The limbs 21, 22 have an elongate extent and are oriented approximately in a U-shaped or V-shaped manner with respect to each other. Between their ends which merge into the connecting body 1, the limbs 21, 22 include a transition 7 which, for example, can also be referred to as a gusset. The transition 7 can be configured in particular as a rounding or chamfer 7. The attachment between the limbs 21, 22 and the connecting body 1 takes place substantially in an attachment region 6.

The press-in contact 100 is preferably formed from a metallic conductive material. In particular, a plate-shaped or strip-shaped semifinished product which is substantially formed as flat material is involved. It is preferred if the press-in contact 100 is formed from a punchable or cuttable material. For example, it can be a material of the thickness d, also compare FIG. 1*b*. The connecting body 1 and the limbs 21, 22 can therefore have substantially the same thickness d. The limbs 21, 22 can furthermore have a width b. Along their longitudinal extent, the limb elements 21, 22 according to the rough shape illustrated in FIG. 1*a* can have substantially rectangular cross sections. In principle, it is conceivable also to design the limbs 21, 22 with substantially square cross sections. However, in particular because of the punching operation or cutting operation, changes in shape can also be produced in the limbs 21, 22, and therefore cross sections differing from the rectangular shape are also conceivable.

Figure 2A:
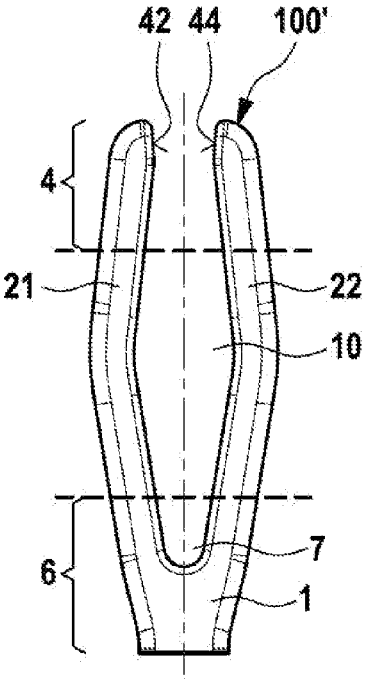
FIG. 2*a* shows a schematically illustrated top view of a press-in contact which has been shaped by stamping and is based on the rough contour shown in FIG. 1*a;*
Figure 2B:
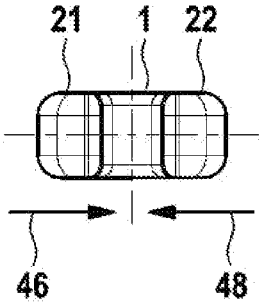
FIG. 2*b* shows a schematically illustrated front view of the press-in contact shaped by stamping according to FIG. 2*a;*

The intermediate state, illustrated in FIGS. 2*a* and 2*b*, of a press-in contact 100' differs from the rough state, shown in FIGS. 1*a* and 1 *b*, of the press-in contact 100 essentially in that smoothing and/or rounding of at least some of the edges of the rough contour have/has taken place. Such an operation can be realized in particular by means of stamping. The stamping can be combined with a punching and/or cutting operation. The smoothing and/or rounding of edges, in particular of cut edges or punched edges, can contribute to avoiding stress concentrations which may arise under some circumstances during subsequent reshaping operations and/or during the joining of the press-in contact 100. Furthermore, for example, the risk of injuries during the manual handling of the press-in contact 100 can be reduced.

Each of the limbs 21, 22 furthermore has an end region 4 which faces away from the connecting body 1. Contact portions 42, 44 can be provided in the end region 4 of the limbs 21, 22. The limb 21 can be the contact portion 42. The limb 22 can be the contact portion 44. In the manufacturing stage illustrated in FIGS. 2*a* and 2*b*, the contact portions 42, 44 of the limbs 21, 22 are significantly spaced apart from each other. A minimum distance between the contact portions 42, 44 can be defined, for example, by a minimum wall thickness of a punching tool or cutting tool with which the rough contour of the press-in contact 100 is produced. According to the basic configuration shown in FIGS. 1*a* and 1 *b*, the limbs 21, 22 define therebetween an intermediate space 10, which, however, is not surrounded by a closed contour since there is (initially) no touching between the contact portions 42, 44.

Figure 3A:
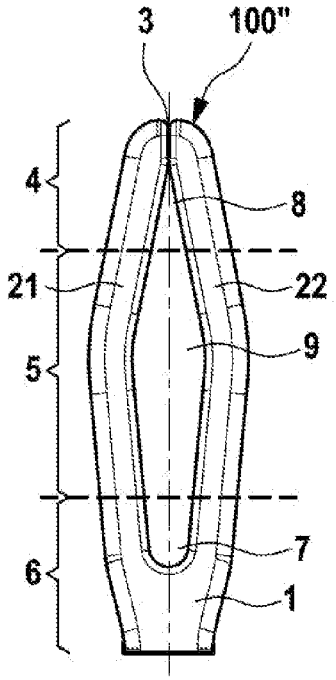
FIG. 3*a* shows a schematically illustrated top view of a press-in contact according to FIG. 2*a* in a reshaped state in which limbs of the press-in contact touch in sections.
Figure 1B:
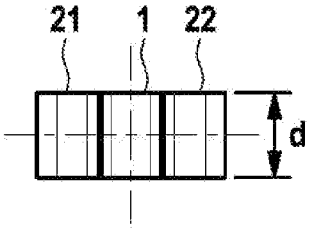
FIG. 1*b* shows a schematically illustrated front view of the rough contour of the press-in contact according to FIG. 1*a;*
Figure 3B:
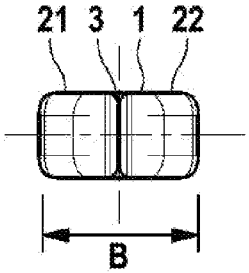
FIG. 3*b* shows a schematically illustrated front view of the press-in contact according to FIG. 3*a;*

FIGS. 3*a* and 3*b* illustrate a further manufacturing stage in which the limbs 21, 22 are moved toward each other in such a manner that the contact portions 42, 44 (compare FIG. 2*a*) touch at least in sections. In this manner, the limbs 21, 22 can together form a point 3 which is closed. In other words, the closed point 3 does not have a gap or a spacing. In order to produce the contact connection, the contact portions 42, 44, or at least one of the contact portions 42, 44, can be moved toward each other in a longitudinal direction, compare arrows denoted by 46, 48 in FIG. 2*b*. By producing a plastic deformation at least in the case of one of the limbs 21, 22, the state, shown in FIG. 3*a*, of the press-in contact 100" can be kept stable.

By closing the limbs 21, 22, the intermediate space 10 can be converted into an inner contour or an inner space 9 which now has a closed boundary. In general, the inner space 9 has an elongate extent and is configured to be substantially oval or elliptical or in the form of a gusset or spherical lune. The inner space 9 can be provided with the rounding 7 in particular at the end thereof facing the connecting body 1 and with a point 8 at the end thereof facing away from the connecting body 1. Overall, the inner space 9 can be configured in an almond-shaped manner. The limbs 21, 22 can each have a press-in region 5 between the end regions 4 thereof and the attachment regions 6. According to the view shown in FIG. 3*a*, the press-in region 5 of each limb 21, 22 can be arched convexly outward. In the closed state of the limbs 21, 22, it is possible in the press-in regions 5 overall to produce a limb dimension or a width B, compare FIG. 3*b*. The limb dimension B has to be adapted in a particular manner to a size of a contact receptacle in order to be able to provide a secure press-in connection. It would therefore be advantageous to be able to manufacture the limb dimension B with a high degree of reproducibility and tolerances which are as small as possible. By the limbs 21, 22 being reshaped in such a manner that their end regions 42, 44 at least partially touch, the limb dimension B can be defined in a highly precise manner. Nevertheless, various advantages which arise by means of the configuration of the press-in contact 100" as a press-in contact with "separate" limbs 21, 22 can be maintained.

A further advantageous embodiment of the method and a press-in contact 100*a* produced in the process are illustrated with reference to FIGS. 4*a* to 8*b*.

Figures 4A, 4B, 5A, 5B, 6A, 6B, 7A, 7B, 8A, 8B:
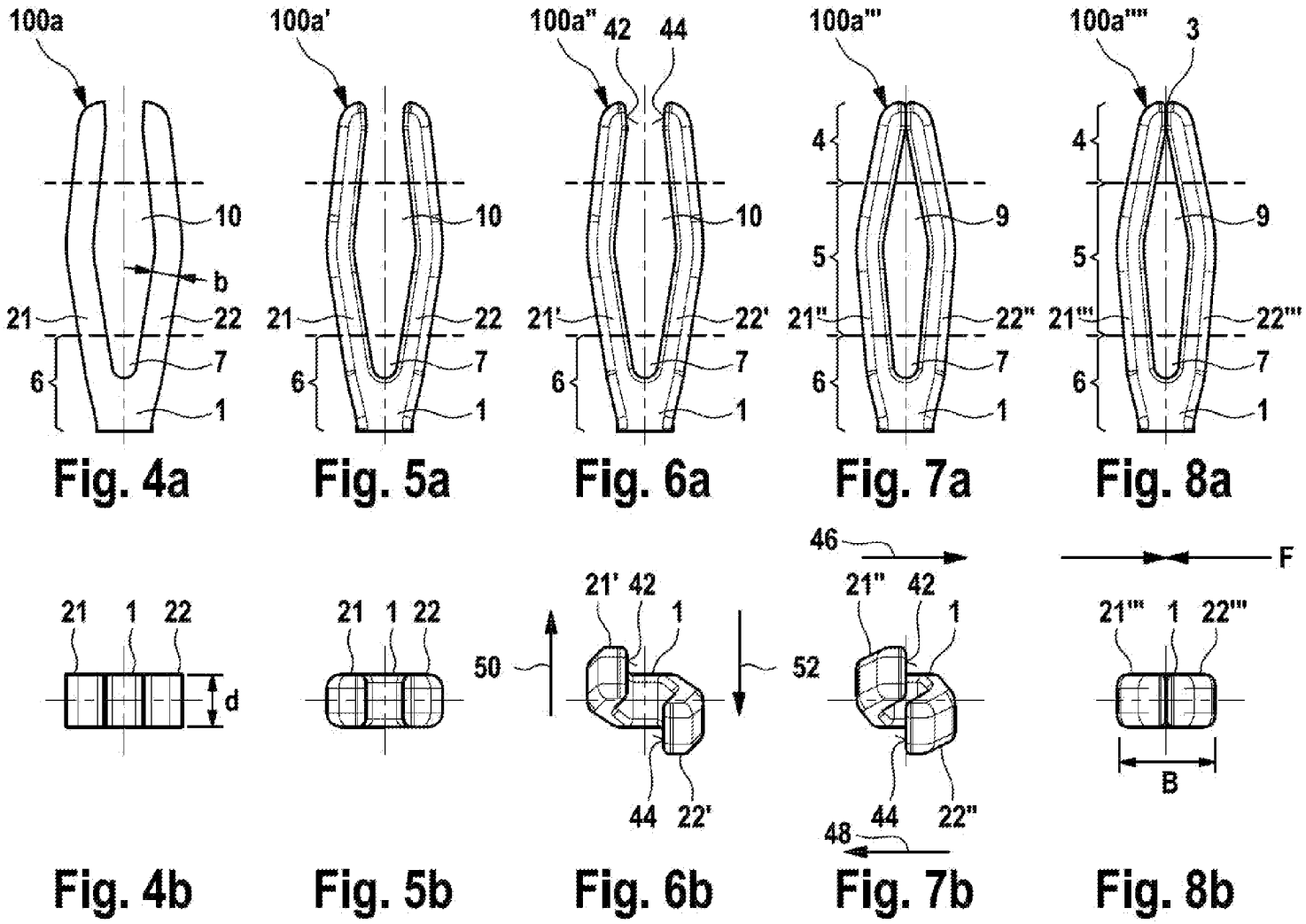
FIG. 4*a* shows a schematically illustrated top view of a rough contour of a further press-in contact with two opposite limbs.
FIG. 4*b* shows a schematically illustrated front view of the rough contour of the press-in contact according to FIG. 4*a;*
FIG. 5*a* shows a schematically illustrated top view of a press-in contact in accordance with the rough contour shown in FIG. 4*a*, in a state shaped by stamping.
FIG. 5*b* shows a schematically illustrated front view of the press-in contact according to FIG. 5*a;*
FIG. 6*a* shows a schematically illustrated top view of a press-in contact according to FIG. 5*a* with laterally disengaged limbs.
FIG. 6*b* shows a schematically illustrated front view of the press-in contact according to FIG. 6*a;*
FIG. 7*a* shows a schematically illustrated top view of a press-in contact according to FIG. 6*a* with limbs deformed in a longitudinal direction.
FIG. 7*b* shows a schematically illustrated front view of the press-in contact according to FIG. 7*a;*
FIG. 8*a* shows a schematically illustrated top view of a press-in contact according to FIG. 7*a* with limbs which are returned into a lateral neutral position and touch each other at least in sections.
FIG. 8*b* shows a schematically illustrated front view of the press-in contact according to FIG. 8*a;*

FIGS. 4*a*, 4*b*, 5*a* and 5*b* may substantially correspond to FIGS. 1*a*, 1 *b*, 2*a* and 2*b*. FIGS. 4*a* and 4*b* show a press-in contact 100*a* in the rough state, i.e., for example, as a punched rough part. The press-in contact 100*a* has in a known manner a connecting body 1 and two limbs 21, 22 adjoining the latter. The limbs 21, 22 have a substantially V-shaped or U-shaped arrangement. The press-in contact 100*a* can be punched by way of example from a semi-finished product of thickness d (compare FIG. 4*b*).

FIGS. 5*a* and 5*b* illustrate a press-in contact 100*a*' which is based on the press-in contact 100*a* according to FIG. 4*a* and furthermore has rounded or smoothed edges and burrs. The roundings or smoothings of the press-in contact 100*a*' can be produced in particular by means of stamping. In a known manner, the limbs 21, 22 can define an (open) intermediate space 10 therebetween. FIGS. 6*a* and 6*b* illustrate a deformation step in which the limbs 21, 22 of a press-in contact 100*a*" are deflected laterally. The deflected limbs are denoted by 21' and 22' in FIG. 6*b*. The lateral deflection can take place in the direction of arrows denoted by 50 and 52 in FIG. 6*b*. The lateral deflection can be limited essentially to contact portions 42, 44 of the limbs 21, 22.

In other words, at most only an extremely small lateral deflection can take place, for example, in the attachment region 6 of the limbs 21, 22. The arrows 50, 52 in FIG. 6*b* illustrate by way of example a (lateral) direction which is oriented substantially perpendicularly to a central plane or neutral plane through the press-in contact 100*a*". It is preferred if the limbs 21', 22' are deflected laterally to such an extent that at least the contact portions 42, 44 are completely offset laterally with respect to each other. This state is shown in FIG. 6*b*. The lateral deflection can in principle take place purely elastically. However, it is also conceivable to at least partially also plastically deform the limbs 21', 22' during the lateral deflection.

Based on the position shown in FIG. 6*b*, the limbs 21', 22' can advantageously be deformed toward each other in a particular manner in order to permit a state in which the contact portions 42, 44 at least partially make contact with each other, with a prestress being formed. Such an operation is illustrated by FIGS. 7*a* and 7*b*. FIG. 7*b* shows that the limbs 21", 22" can be moved toward each other from the position shown in FIG. 6*b*. Said movement (also: longitudinal movement) is illustrated in FIG. 7*b* by arrows denoted by 46, 48. It is furthermore apparent from FIG. 7*b* that the limbs 21", 22" can not only be moved toward each other but even at least partially past each other at least in the region of the contact portions 42, 44 thereof. Even if, according to the illustration of a press-in contact 100*a*'" that is shown in FIG. 7*a*, there is apparently contact between the contact portions 42, 44, a relative movement of the limbs 21", 22" beyond this state is made possible.

This is particularly advantageous since a plastic deformation of the limbs 21", 22" can thereby be produced, said deformation then being able to provide a prestressing force when the limbs 21", 22" are returned again into the neutral position thereof. In other words, the movement of the limbs 21", 22" is not limited by a stop which would be provided by the contact of the contact portions 42, 44 if the contact portions 42, 44 do not overlap laterally. The limbs 21", 22" can therefore be "overstretched" in the longitudinal direction (arrows 46, 58). If the limbs 21", 22" should then be relieved of load, it would be conceivable for said limbs to remain in a mutually at least partially overlapping position in the laterally disengaged state.

FIGS. 8*a* and 8*b* illustrate a state of a press-in contact 100*a*"" that is based on the state according to FIGS. 7*a* and 7*b*, but wherein the limbs and in particular the contact portions 42, 44 therefore are returned into the (lateral) neutral position thereof, compare reference signs 21'", 22'" in FIG. 8*b*. This can secondly take place using a (lateral) elastic resetting force of the limbs 21'", 22'". However, should a plastic deformation of the limbs 21'", 22'" occur in the lateral direction, for example, in the event of the lateral disengagement illustrated in FIGS. 6*a* and 6*b*, an oppositely directed plastic deformation can bring about the neutral state of the limbs 21'", 22'" that is shown in FIG. 8*b*. Nevertheless, the contact portions 42, 44 can come into contact with each other in a defined manner with a prestressing force F being formed. The prestressing force F can be defined in particular by targeted overstretching of the limbs 21'", 22'", also compare FIG. 7*b*. Analogously to the state shown in FIG. 3*a*, in the case of the press-in contact 100*a*"" it is possible to produce a press-in region 5 which, owing to the defined contact between the contact portions 42, 44, leads to a limb dimension B (compare FIG. 8*b*) which has small tolerances and can be reproduced highly precisely.

In particular, the lateral disengaging step illustrated in FIGS. 6*a* and 6*b* permits a significant deformation of the limbs 21, 22 of the press-in contact 100*a*. Inherent stresses in the material of the press-in contact 100*a* can therefore be produced in a specific manner and used in order to improve the dimensional stability and functional reliability thereof. It goes without saying that in particular the steps, shown in FIGS. 6*a* to 7*b*, of the lateral disengagement and of the limbs 21, 22 moving toward each other can take place as a consequence of a combined movement. The steps can in principle be executed simultaneously, but furthermore also in a manner offset in terms of time. As already explained above, it is preferred if the two limbs 21, 22 are deflected and reshaped in a symmetrical manner. In principle, however, it is also conceivable to move and to deform just one of the two limbs 21, 22 in a corresponding manner.

Figure 9:
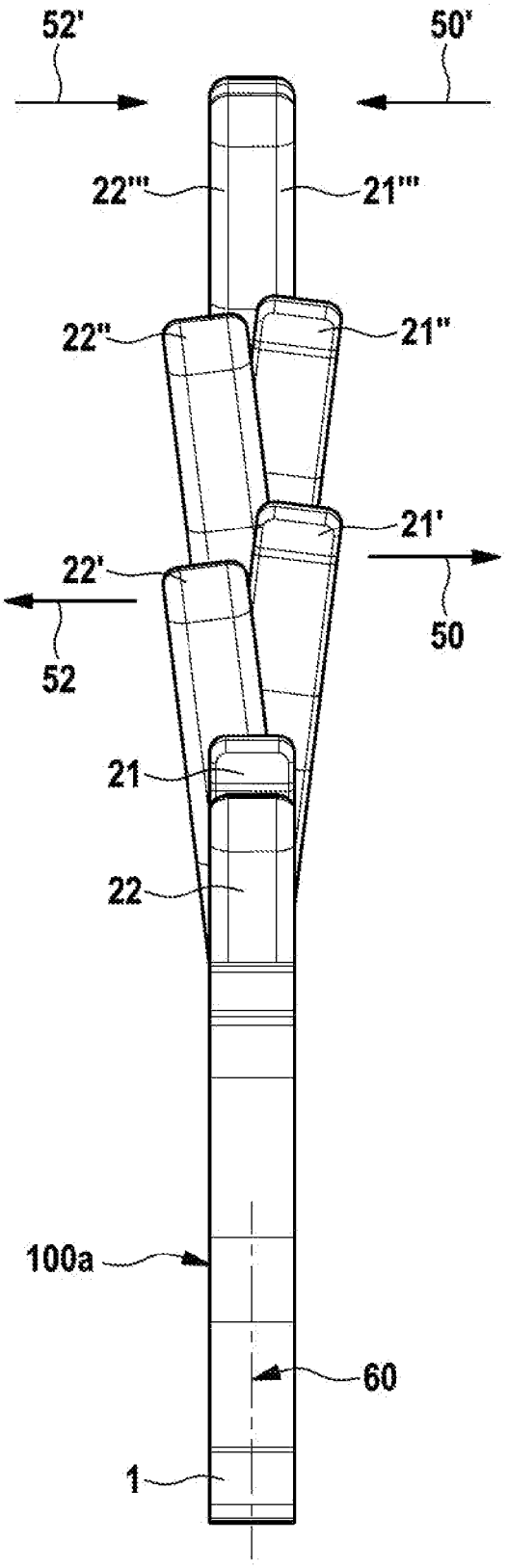
FIG. 9 shows a schematically illustrated illustration of a sequence of lateral positions of the limbs of a press-in contact according to FIGS. 4*a* to 8*b;*

FIG. 9 shows, merely for illustrative purposes, a superimposition of various states of the press-in contact 100*a* that approximately correspond to the positions shown in FIGS. 5*b* to 8*b*. A lateral neutral plane or plane of symmetry of the press-in contact 100*a* or of the semi-finished product used for the manufacturing thereof is indicated at 60. FIG. 9 illustrates the press-in contact 100*a* in slightly tilted form in order to make both of the limbs 21, 22 visible even in the neutral position despite a symmetrical configuration of the limbs 21, 22.

In the punched and optionally stamped state, the limbs 21, 22 are in the neutral position thereof (laterally). In a further step which is also illustrated with reference to FIGS. 6*a* and 6*b*, a lateral disengagement of the limbs takes place, compare reference signs 21', 22', in the direction of the arrows denoted by 50 and 52. In said disengaged state, the limbs can be deformed relative to each other in the longitudinal direction, compare the reference signs 21", 22". According to the orientation shown in FIG. 9, this can take place approximately substantially perpendicularly to the viewing plane there. In this manner, a plastic deformation of the limbs 21", 22" can take place, said plastic deformation being usable in order to produce a prestress. The limbs can subsequently be transferred again into the neutral position thereof with respect to the neutral plane 60, compare reference signs 21''' and 22'''. This can take place along arrows denoted 50', 52'. The return of the limbs 21''', 22''' can basically take place using the inherent elasticity thereof. Alternatively or additionally, it is, however, also conceivable for the limbs 21''', 22''' also to be returned by plastic deformation.

A further advantageous embodiment of a press-in contact 100*b* is illustrated with reference to FIGS. 10*a* and 10*b*. In a known manner, the press-in contact 100*b* has a connecting region 1 and two limbs 21, 22 which adjoin the latter and are configured substantially symmetrically to each other. The limbs 21, 22 are attached to the connecting body 1 in an attachment region 6. The limbs 21, 22, on their end region 4 facing away from the connecting body 1, have contact portions 42, 44 which at least partially touch each other, in particular with a prestressing force being formed. In this manner, the contact portions 42, 44 of the limbs 21, 22 can form a closed point 3. In order to produce the configuration shown in FIG. 10*a*, use can be made, for example, of the method illustrated according to FIGS. 4*a* to 8*b*.

Between the end region 4 and the attachment region 6, the limbs 21, 22 can define a press-in region 5, in which a limb dimension B is produced, also compare FIG. 10*b*. An inner contour or a (closed) inner space 9 of approximately almond-shaped design can be produced between the limbs 21, 22. In the direction of the connecting body 1, the inner space 9 can have a rounded end or a chamfer 7. In the direction of the point 3, the inner space 9 can have a tapering end 8.

In contrast to the previously described press-in contacts 100 and 100*a*, the press-in contact 100*b* has a substantially continuously curved configuration of the limbs 21, 22. In particular, the limbs 21, 22 of the press-in contact 100*b* are embodied substantially without rectilinear portions in the longitudinal extent thereof. For example, in the case of the limb 22, a limb radius is indicated that is denoted by R and extends over substantial regions of the limb 22, at least over the press-in region 5. A targeted adaptation of the limb radius R permits an optimization of a plug-in force or joining force during the installation of the press-in contact 100*b* and optimization of the contact surface of the press-in contact 100*b* upon contact with a contact receptacle, for example a receiving bushing. It is of advantage here if a back of the press-in contact 100*b* bears in as planar a manner as possible against a corresponding contact receptacle.

Furthermore, the limb 22 has an inner transition radius which is denoted by r and describes a transition between the press-in region 5 and the end region 4, in particular the contact portion 44 thereof. A suitable configuration of the transition radius r permits a targeted deformation of the limbs 21, 22 of the press-in contact 100*b* during the insertion into a contact receptacle. In particular, the transition radii r of the two limbs 21, 22 can nestle against each other when the press-in region 5 of the limbs 21, 22 is pressed together during the joining. Therefore, in the case of the press-in contact 100*b* according to FIG. 10*a*, an inner space 9 can be produced, the rounding 7 of which, which faces the connecting body 1, merges into a concave rounding which extends substantially over at least the press-in region 5, wherein the convex transition radius r adjoins the latter and tapers in the direction of the point 3 of the press-in body 100*b*.

The previously described press-in contacts 100, 100*a* and 100*b* can be used, for example, in vehicle manufacturing or in similar use areas in which high currents flow. Customary dimensions for the thickness d of the semi-finished product (compare FIG. 1*b*) can be approximately within the range of a few tenths of a millimeter up to several millimeters. A limb dimension B of approximately 2.5×d to 4×d can be produced. The limbs 21, 22 can have a width b perpendicular to the thickness d of similar orders of magnitude as the thickness d. In principle, the limbs 21, 22 can have a square cross section. However, it is also conceivable for the thickness d to be greater than the width b. Conversely, it is conceivable for the thickness d to be smaller than the width b. It is preferred if the lateral deflection of the limbs 21, 22 brings about an offset which is greater than or equal to the thickness d at least in the region of the contact portions 42, 44. In particular if the offset is greater than the thickness d, the limbs 21, 22 can be guided past each other.

Figure 14A:
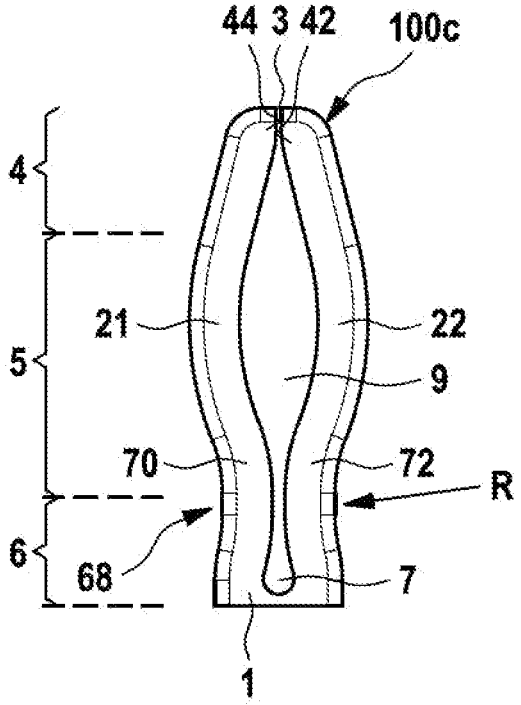
FIG. 14*a* shows a schematically illustrated top view of a further embodiment of a press-in contact in a reshaped state.
Figure 14B:
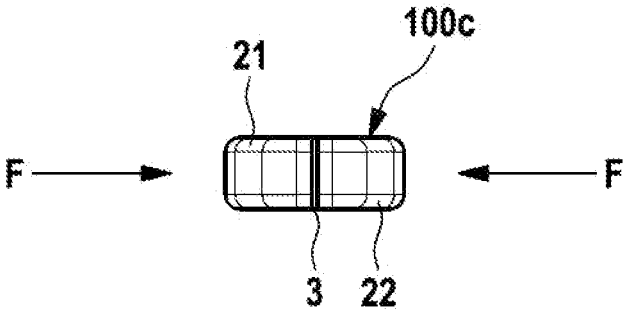
FIG. 14*b* shows a schematically illustrated front view of the press-in contact according to FIG. 14*a*.

However, it goes without saying that configurations of the press-in contacts 100, 100*a*, 100*b* and of the press-in contact 100*c*, which is illustrated below with reference to FIGS. 14*a* and 14*b*, which differ from the above-described dimensions are also conceivable.

Figure 12:
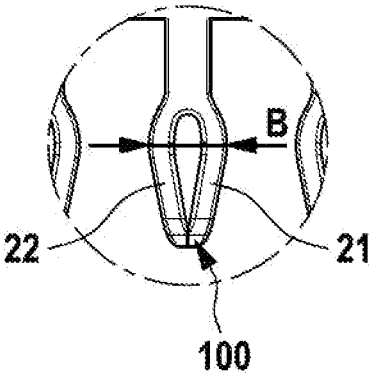
FIG. 12 shows a view of a detail of an excerpt of the illustration shown in FIG. 11.

FIGS. 11 and 12 illustrate by way of example a busbar 302 which is representative of a multiplicity of conceivable contact components. The busbar 302 has by way of example five contact elements 100, of which one is illustrated enlarged in sections in FIG. 12, compare detail X. By means of a plurality of press-in contacts 100, a parallel contact connection can take place to a certain extent in order to be able to transmit particularly high currents. In this manner, for example, several hundred amperes can be transmitted. It is preferred if the busbar 302 shown in FIG. 11 and all of the press-in contacts 100 accommodated thereon are configured as a single piece.

Figure 13:
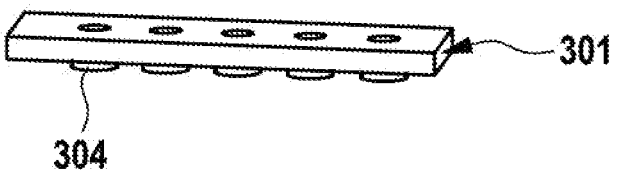
FIG. 13 shows a perspective view of a printed circuit board element with a plurality of contact receptacles for press-in contacts.

FIG. 13 illustrates a printed circuit board element 301 which has a plurality of contact receptacles 304, in particular receiving bushings. The contact elements 304 can customarily be bores or similar design elements. The contact receptacles 304 can be metalized and/or can have metallic inserts. The printed circuit board element 301 can be matched to the busbar 302 and can provide, for example, five corresponding contact receptacles 304 in order, in a joined state, to be able to accommodate the five press-in contacts 100 of the busbar 302.

A further advantageous embodiment of the method and a press-in contact 100*c* produced in the process are illustrated with reference to FIGS. 14*a* and 14*b*. The press-in contact 100*c* can be basically produced analogously to the press-in contacts 100, 100*a*, 100*b* using the above-described manufacturing steps. In particular, the limbs 21, 22 of the press-in contact 100*c* can be prestressed in the above-described manner in order, after a reshaping operation, to touch in a defined manner at least in sections in the region of the contact portions 42, 44 thereof.

The press-in contact 100*c* is distinguished in particular in respect of the configuration of the transition between the press-in region 5 and the attachment region 6 by a modified configuration of the limbs 21, 22. The limbs can be provided with a constriction 68, which is formed by curved portions 70, 72, between the rounding 7 associated with the connecting body 1 and the inner space or the inner contour 9. A curved portion 70 is provided in the case of the limb 21. A curved portion 72 is provided in the case of the limb 22. The curved portions 70, 72 can be configured to be substantially convex on the mutually facing sides thereof and substantially concave on the sides thereof which face away from each other. An arrow denoted by R indicates in FIG. 14*a* a concave curvature of the portion 72 in the case of the limb 22. Each of the limbs 21, 22 can thus have an S-shaped configuration. Accordingly, the transition between the inner space 9 and the rounding 7 of the press-in contact 100*c* can comprise a narrow point.

This contour of the press-in contact 100*c* can be produced in particular as a rough contour, for example by punching a corresponding blank. A rough contour with limbs 21, 22 forming a constriction 68 may be of advantage in the reshaping step. Mutually facing inner surfaces of the portions 70, 72 in the region of the narrow point can come into contact with each other during the reshaping step. A favorable force profile can thereby be produced during the reshaping of the limbs 21, 22. This configuration can also be of advantage after the reshaping of the limbs 21, 22. When the press-in contact 100*c* is pressed into a contact receptacle 304 (cf. FIG. 13) the mutually facing inner surfaces of the portions 70, 72 can enter into contact with each other. The stresses produced in the press-in contact 100*c* during the pressing-in operation can thereby be defined even more precisely. Furthermore, the configuration of the press-in contact 100*c* illustrated with reference to FIGS. 14*a* and 14*b* can contribute to further reducing stresses in the attachment region 6, at which the limbs 21, 22 merge into the connecting body 1.

Figure 15:
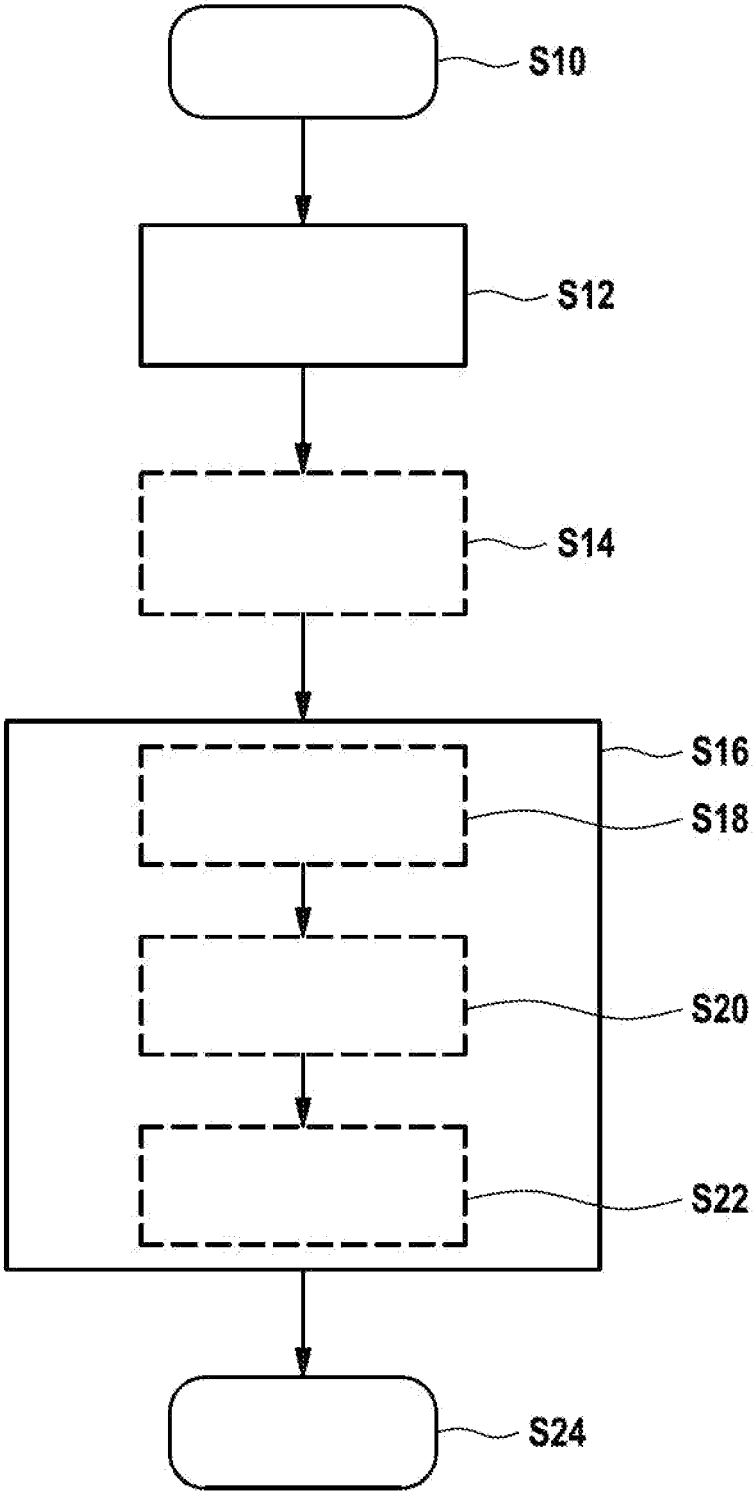
FIG. 15 shows a schematically highly simplified sequence diagram of a method for manufacturing press-in contacts.

FIG. 15 shows, in a simplified manner, a schematic sequence diagram of a method for manufacturing a press-in contact. The method can start at a step S10. This is followed by a step S12 in which a rough shape or rough contour of a press-in contact is produced. This can take place in particular by means of a separating method. A non-cutting separating method is preferably involved here. For example, the rough contour can be produced by means of punching, cutting or precise cutting. The rough contour of the press-in contact preferably comprises a connecting body and two limb elements or limbs extending from the latter. In particular, the limbs can be formed substantially symmetrically to each other and can substantially extend in the longitudinal direction for example as limbs of a V or U. It is preferred if the limbs have contact portions in the end regions thereof facing away from the connecting body, but said contact portions do not touch in the rough contour.

This can be followed by a step S14 in which edges of the rough contour of the press-in contact are smoothed or rounded. However, in principle, step S14 can also be passed over. According to some configurations, step S14 can be combined with step S12. For example, it is conceivable to produce and to smooth the rough contour of the press-in contact by means of a combined punching/stamping operation. Burrs and/or punched edges can be deburred by means of stamping.

This is followed by step S16 which involves reshaping the press-in contact. The limbs of the press-in contact, in particular the contact portions thereof, are advantageously plastically preshaped here in such a manner that there is at least partial touching between the contact portions of the limbs after the reshaping operation. This can contribute in a particular manner to improving the dimensional stability of the press-in contact.

According to various embodiment embodiments, the reshaping step S16 can comprise various partial steps. For example, a step S18 can be provided in which at least one limb, preferably both limbs, is/are deflected laterally. Said step can relate in particular to the contact portions of the limbs. This can be followed by a step S20 in which the limbs, in particular the contact portions thereof, are moved toward each other. The contact portions of the limbs are preferably laterally disengaged here in such a manner that said contact portions can be at least partially moved past each other. In this manner, the limbs can be plastically deformed in a particular manner. This can be followed by a further step S22 in which the (laterally deflected) limbs are returned laterally into the starting position or neutral position thereof. Since, however, at least one of the limbs, preferably both limbs, has/have been plastically deformed in the direction toward each other, after the limbs are returned, there can be touching at least in sections between the contact portions. The limbs have preferably been deformed in such a manner that the touching takes place with the production of a prestress. The touching between the contact portions can thereby be reproduced particularly securely and readily in terms of process engineering. This can be followed by a step S24 which terminates the method.

It goes without saying that the method can be used in order simultaneously to manufacture a plurality of press-in contacts which, for example, are formed as a single piece with a suitable carrier component, for example a busbar. Overall, it is possible with the method to manufacture press-in contacts which are suitable for transmitting large currents and which can be fitted simply and reliably. The design of the press-in contacts with two limbs, the contact portions of which basically are not rigidly connected to each other, but touch each other in a defined manner, affords various advantages.

A press-in contact according to one of the abovementioned aspects is suitable both for permanent press-in connections which are not designed as releasable plug-type connections, and also for releasable plug-type connections. Releasable plug-type connections can be produced and separated repeatedly. Accordingly, the press-in contact, at least according to some embodiment embodiments, can generally also be a plug-type contact.

The invention claimed is:

1. A component assembly comprising at least one contact receptacle and at least one plug-type contact for producing an electric connection, with a flat connecting body and two curved limbs having two flat sides adjoining the connecting body, wherein the connecting body and the limbs are configured as a single flat piece, wherein each limb has a press-in region and an end region with a contact portion, wherein the two limbs define a substantially almond-shaped inner contour, and wherein the contact portions of the two limbs face each other and touch in a defined manner at least in sections, wherein the plug-type contact is received in the contact receptacle by being prestressed;

wherein the limbs have an attachment region for attachment to the flat connecting body, wherein the limbs have a concave constriction at a transition between the press-in region and the attachment region, said constriction being formed by curved portions of the limbs, wherein end regions of the limbs which face the connecting body furthermore have an inner rounding which merges into an inner space defined between the limbs, and wherein the concave constriction of the limbs defines a narrow point between the inner space and the inner rounding, wherein the curved portions of the limbs are configured to touch each other at the narrow point when received in the contact receptacle, and wherein the inner space is larger than the inner rounding.

2. A press-in contact, in particular punched press-in contact for producing an electric connection, with a flat connecting body and two curved limbs having two flat sides adjoining the connecting body, wherein the connecting body and the limbs are configured as a single flat piece, wherein each limb has a press-in region and an end region with a contact portion, wherein the two limbs define a substantially almond-shaped inner contour, and wherein the contact portions of the two limbs face each other and touch in a defined manner at least in sections, wherein the limbs have an attachment region for attachment to the connecting body, wherein the limbs have a concave constriction at a transition between the press-in region and the attachment region, said constriction being formed by curved portions of the limbs, wherein end regions of the limbs which face the connecting body furthermore have an inner rounding which merges into an inner space defined between the limbs, and wherein the concave constriction of the limbs defines a narrow point between the inner space and the inner rounding, wherein the curved portions of the limbs are configured to touch each other at the narrow point when received in the contact receptacle, and wherein the inner space is larger than the inner rounding.

3. The plug-type contact as claimed in claim 2, wherein the plug-type contact is defined as a press-in contact, in particular as a punched press-in contact.

4. The plug-type contact as claimed in claim 2, wherein the contact portions of the two limbs are prestressed against each other with a contact force.

* * * * *